US011519268B2

(12) United States Patent
Lindsey

(10) Patent No.: US 11,519,268 B2
(45) Date of Patent: Dec. 6, 2022

(54) ROTARY PISTON AND CYLINDER DEVICE WITH FLARED CURVED ROTOR SURFACE

(71) Applicant: LONTRA LIMITED, Warwickshire (GB)

(72) Inventor: Stephen Francis Lindsey, Warwickshire (GB)

(73) Assignee: LONTRA LIMITED, Warwickshire (GB)

( * ) Notice: Subject to any disclaimer, the term of this patent is extended or adjusted under 35 U.S.C. 154(b) by 136 days.

(21) Appl. No.: 16/329,855

(22) PCT Filed: Sep. 1, 2017

(86) PCT No.: PCT/GB2017/052558
§ 371 (c)(1),
(2) Date: Mar. 1, 2019

(87) PCT Pub. No.: WO2018/042149
PCT Pub. Date: Mar. 8, 2018

(65) Prior Publication Data

US 2019/0242258 A1 Aug. 8, 2019

(30) Foreign Application Priority Data

Sep. 2, 2016 (GB) ..... 1614972

(51) Int. Cl.
*F01C 3/02* (2006.01)
*F01C 21/08* (2006.01)

(52) U.S. Cl.
CPC ..... *F01C 3/02* (2013.01); *F01C 3/025* (2013.01); *F01C 21/08* (2013.01); *F04C 2240/20* (2013.01); *F04C 2250/20* (2013.01)

(58) Field of Classification Search
CPC .. F01C 3/02; F01C 3/025; F01C 21/08; F01C 21/104; F01C 21/02; F04C 2250/20; F04C 2240/20; F04C 2250/201; F04C 2250/30
See application file for complete search history.

(56) References Cited

U.S. PATENT DOCUMENTS

| | | | | |
|---|---|---|---|---|
| 2,327,089 A | 8/1943 | Walter | | |
| 3,897,756 A | 8/1975 | Upchurch | | |
| 6,547,545 B1 * | 4/2003 | Jonsson | F01C 3/02 418/195 | |

FOREIGN PATENT DOCUMENTS

| | | |
|---|---|---|
| CH | 107274 | 10/1924 |
| CH | 276236 | 6/1951 |

(Continued)

OTHER PUBLICATIONS

International Search Report issued in corresponding International Patent Application No. PCT/GB2017/052558 dated Nov. 8, 2017.

(Continued)

*Primary Examiner* — Dominick L Plakkoottam
*Assistant Examiner* — Paul W Thiede
(74) *Attorney, Agent, or Firm* — Whiteford, Taylor & Preston LLP; Peter J. Davis

(57) ABSTRACT

A rotary piston and cylinder device comprising a rotor (2), comprising a rotor surface (2*a*), a stator (4), a rotatable shutter (3), a piston (5) which extends from the rotor surface, the rotor surface and the stator together defining an annular chamber, and the piston arranged to rotate, through the annular chamber, and the rotor surface being orientated at an incline to a plane (P-P) substantially perpendicular to the axis of rotation (A-A) of the rotor and the rotor surface faces generally away from, or outwardly of, the axis of rotation of the rotor.

7 Claims, 14 Drawing Sheets

(56) References Cited

FOREIGN PATENT DOCUMENTS

| | | | | |
|---|---|---|---|---|
| DE | 351142 | | 4/1922 | |
| EP | 0933500 | | 8/1999 | |
| EP | 0933500 | A1 * | 8/1999 | ..... F01C 3/02 |
| GB | 2438859 | | 12/2007 | |
| JP | 60-17284 | | 1/1985 | |
| WO | 2007093818 | | 8/2007 | |
| WO | 2010023487 | | 3/2010 | |
| WO | 2016012804 | | 1/2016 | |

OTHER PUBLICATIONS

Office Action issued in corresponding Chinese Patent Application No. 201780067398.2 dated Aug. 10, 2020.
Office Action issued in corresponding European Patent Application No. 17764633.8 dated Mar. 12, 2020.
Office Action issued in corresponding Eurasian Patent Application No. 201990478/31 dated Apr. 6, 2020.
Notification issued in co-pending Eurasian Application No. 201990478 dated Dec. 18, 2020.
Japanese Office Action issued in co-pending application No. dated Aug. 24, 2021.

* cited by examiner

Cross-section viewed on plane G

ROTARY PISTON AND CYLINDER DEVICE WITH FLARED CURVED ROTOR SURFACE

TECHNICAL FIELD

The present invention relates generally to rotary piston and cylinder devices.

BACKGROUND

Rotary piston and cylinder devices can take various forms and be used for numerous applications, such as an internal combustion engine, a compressor such as a supercharger or fluid pump, an expander such as a steam engine or turbine replacement, or as another form of positive displacement device.

A rotary piston and cylinder device may be considered to comprise a rotor and a stator, the stator at least partially defining an annular chamber or cylinder space, the rotor may be in the form of a ring or comprise an annular (concave in section) surface, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising a cylinder space shutter which is capable of being moved relative to the stator to a closed position in which the shutter partitions the annular cylinder space, and to an open position in which the shutter permits passage of the at least one piston, such as by the shutter being rotatably mounted, the cylinder space shutter may be in the form of a shutter disc.

We have devised a novel configuration of a rotary piston and cylinder device.

SUMMARY

According to a first aspect of the invention there is provided a rotary piston and cylinder device comprising:

a rotor, comprising a rotor surface, a stator, a rotatable shutter, a piston which extends from the rotor surface, the rotor surface and the stator together defining an annular chamber, and the piston arranged to rotate, through the annular chamber, and the rotor surface may be orientated at an incline to a plane substantially perpendicular to the axis of rotation of the rotor, and the rotor surface may face or be directed generally away from, or outwardly of, the axis of rotation of the rotor, for example when viewed in axial cross-section.

The rotor surface may be asymmetrical with respect to a plane which is substantially perpendicular to the axis of rotation of the rotor which plane extends through a mid-region of the rotor surface.

What is termed as the "rotor surface" may be termed an annular surface region of the rotor which defines the working chamber (together with the stator). The end regions of this surface region are located at both of its axial ends, and will generally each form a circular line. Each of these lines lie substantially on a plane, and the mid-region of the rotor surface is located substantially equidistantly between these planes, or put another way, intermediate of the two axial ends.

The inclined orientation of the rotor surface may be viewed as being angularly offset from the perpendicular plane. The angular offset may be in the range 30 degrees to 60 degrees or in the range 40 to 50 degrees.

The rotor surface may present a facing angular orientation which is angularly intermediate of the perpendicular plane and a second plane which is orthogonal thereto which includes the axis of rotation.

More generally, the rotor surface may be orientated at an incline with respect to either the axis of rotation, or with respect to the axis of rotation of the rotor.

The angle of orientation may be defined with reference to a line which connects end/distal portions of the rotor, when viewed in axial cross-section.

The device may comprise a rotational shaft, and with which the rotor may be attached or be integral with, and may extend around the shaft.

The shaft may extend from at least one axial end of the rotor. The shaft may comprise two shaft portions, which each extend away from a respective axial end of the rotor.

The shaft may comprise a unitary component which is arranged to extend through the rotor. The rotor may comprise a central opening through which a rotational shaft can be located. The shaft may be viewed as extending away from (at least) one side of the chamber.

The shaft may provide for rotational input to and/or output from the device.

A rotational bearing may be provided axially spaced from the annular chamber. At least two rotational bearings may be provided axially spaced from the annular chamber and from each other. The rotational bearings may be arranged such that the annular chamber is intermediate of the bearings. The bearings may be arranged so that there is a shaft through the rotor with bearings each side or could be arranged with the bearings only on one side, or could be arranged with a bearing under or axially within the chamber (such a bearing could be arranged to have its outer race rotating in use).

The rotor surface may be of generally flared profile, preferably when viewed in axial cross-section. The rotor surface (which in part defines the working chamber) may extend between a first rotor surface end region and a second rotor surface end region, and the first rotor surface end region being spaced along the axis of rotation of the rotor with respect to the second rotor surface end region, and one of the rotor surface end regions having a greater radial extent than the other end region. Each of the end regions may be located at the distal or extreme region of the rotor surface, with respect to the axis of rotation.

The rotor surface may be at least one of continuous, smooth and curved.

The rotor surface may be provided with one or more ports to allow communication of fluid between the annular chamber and a space external of the chamber.

The port or ports may comprise an opening which extends through to an opening in a rearward surface of the rotor surface which in part defines the working chamber. The rearward surface may be thought of as being opposite to the rotor surface. The rearward surface may be spaced from the rotor surface in the rearward direction, which is the direction generally along the axis of rotation, and away from the chamber with respect to the rotor surface.

A port in communication with the working chamber may exit through a portion of the rearward surface of the rotor and may be axially spaced from the rotor surface.

This may be viewed as providing working fluid porting to or from the annular chamber through the rotor surface.

The term 'piston' is used herein in its widest sense to include, where the context admits, a partition capable of moving relative to a cylinder wall, and such partition need not generally be of substantial thickness in the direction of relative movement but can be in the form of a blade. The piston may be of substantial thickness or may be hollow. The piston may form a partition within the cylinder space. The piston may be arranged to rotate, in use, around the axis of rotation of the rotor.

The term 'seal' includes allowance for an intentional leak path of fluid, by way of a close-spacing between opposed surfaces, and not necessarily forming a fluid-tight formation. Within this scope a seal may be achieved by way of close-running surfaces or a close-running line or a close-running region. The seal may be provided by a sealing gap between opposing surfaces, to minimise or restrict transmission of fluid therethrough. The sealing gaps corresponding to different surfaces may have varying clearances to their respective opposing parts, due to particular assembly and operational requirements.

Although in theory the shutter could be reciprocable, it is preferred to avoid the use of reciprocating components, particularly when high speeds are required, and the shutter preferably comprises one or more shutter discs which are arranged to be positioned substantially in register with the circumferentially- or circularly-extending bore of the annular cylinder space, and is provided with at least one aperture which in the open condition of the shutter permits passage of the at least one piston therethrough.

The rotor and stator may define a working chamber. A surface of the rotor which in part defines the working chamber may be concave or curved in cross-section. The working chamber may be of substantially annular form.

The shutter may present a partition which extends substantially radially of the cylinder space.

The at least one aperture of the shutter may be provided substantially radially in, and with respect to, the shutter.

Preferably the axis of rotation of the rotor is non-parallel to the axis of rotation of the shutter. Most preferably the axis of rotation of the rotor is substantially orthogonal to the axis of rotation of the shutter.

Preferably the piston is so shaped that it will pass through an aperture in the moving shutter, without balking, as the aperture passes through the annular cylinder space. The piston may be shaped so that there is minimal clearance between the piston and the aperture in the shutter, such that a seal is formed as the piston passes through the aperture. A seal may be provided on a surface or edge region of the first side portion of the piston Preferably the stator comprises at least one or more ports. There may be at least one port for inlet flow, and at least one port for outlet flow.

At least one of the ports may be substantially adjacent to the shutter.

At least one of the ports may be positioned such as to form a valved port in cooperation with a port in the rotor.

Preferably the ratio of the angular velocity of the rotor to the angular velocity of the shutter disc is 1:1, although other ratios are possible.

The shutter may be arranged to extend through or intersect the working chamber at (only) one region or location of the cylinder space.

The device, and any feature of the device, may comprise one or more structural or functional characteristics described in the description below and/or shown in the drawings, either individually or in combination.

BRIEF DESCRIPTION OF THE DRAWINGS

Various embodiments of the invention will now be described, by way of example only, with reference to the following drawings in which.

DETAILED DESCRIPTION

Figures 1A, 6:
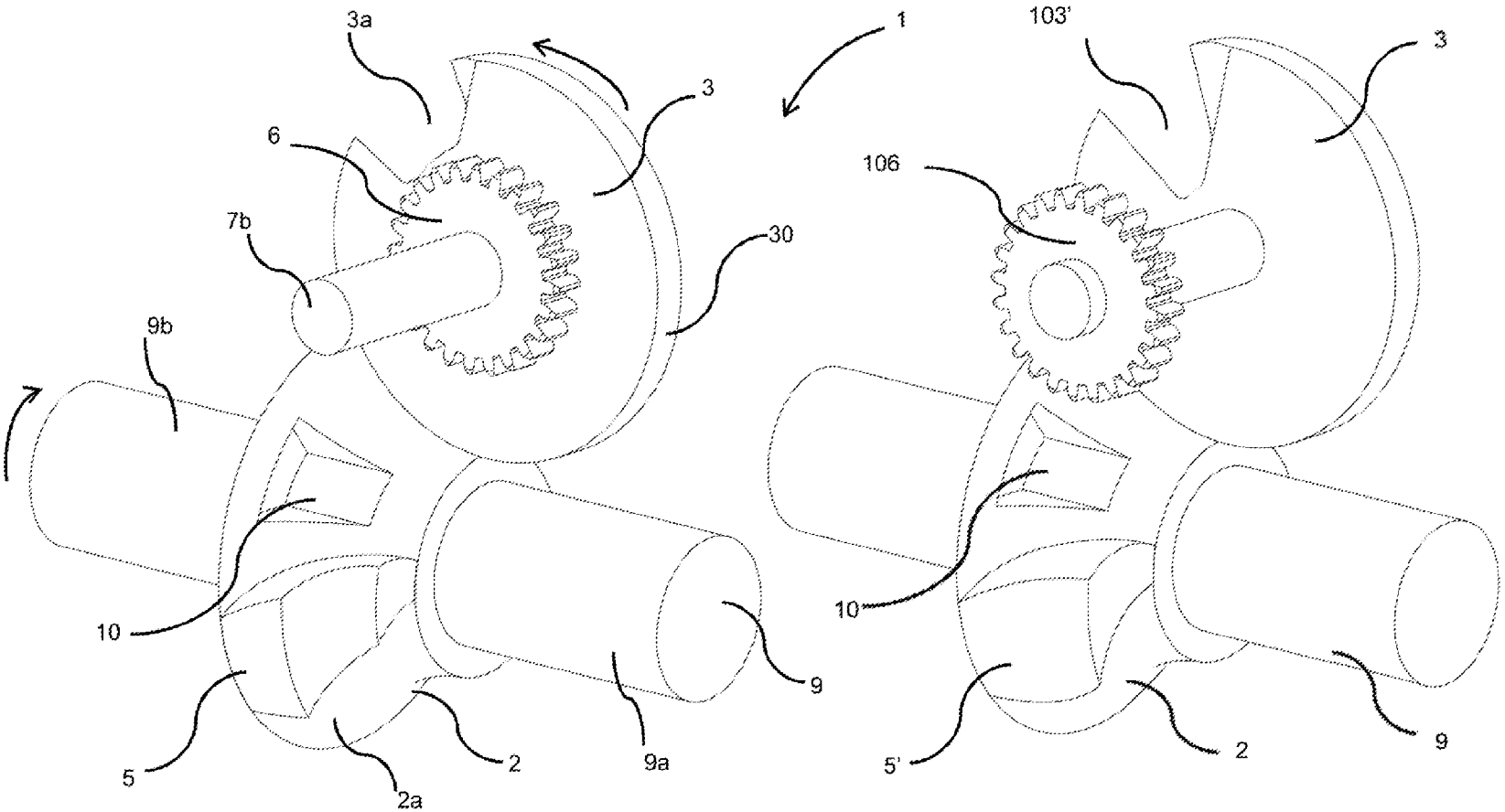
FIG. 1*a* is a perspective view of components of a rotary piston and cylinder device.

Reference is made to the Figures which show a rotary piston and cylinder device 1 which comprises a rotor 2, a stator 4, and a shutter disc 3. The stator, although not shown in some of the Figures for ease of representation, comprises a formation, such as a housing or casing, which is maintained relative to the rotor, and an internal surface of the stator facing a surface 2*a* of the rotor, together define an annular space or working chamber, shown generally at 100. The stator 4 effectively comprises two portions, wherein said stator portions together substantially enclose the rotor and shutter therebetween.

Integral with the rotor and extending from the surface 2*a* there is provided a piston 5. A slot or opening 3*a* provided in the shutter disc 3 is sized and shaped to allow passage of the piston therethrough. Rotation of the shutter disc 3 is arranged to ensure that the timing of the shutter remains in synchrony with the rotor by a suitable transmission.

One of the geared components of a transmission assembly is shown by toothed gear 6. The shutter disc 3 is rotationally mounted by way of shaft portions 7*a* and 7*b*.

In use of the device, a circumferential surface 30 of the shutter disc faces the surface 2*a* of the rotor so as to provide a seal therebetween, and so enable the shutter disc to functionally serve as a partition within the annular cylinder space.

The geometry of the interior (i.e. facing into and in part defining the chamber) surface 2*a* of the rotor is governed by the part of the circumferential surface 30 of the rotating shutter disc.

The rotor and the stator are configured to provide the annular cylinder space with one or more inlet port/s and one or more outlet port/s for the working fluid. One of the ports is described in more detail below.

Figure 1B:
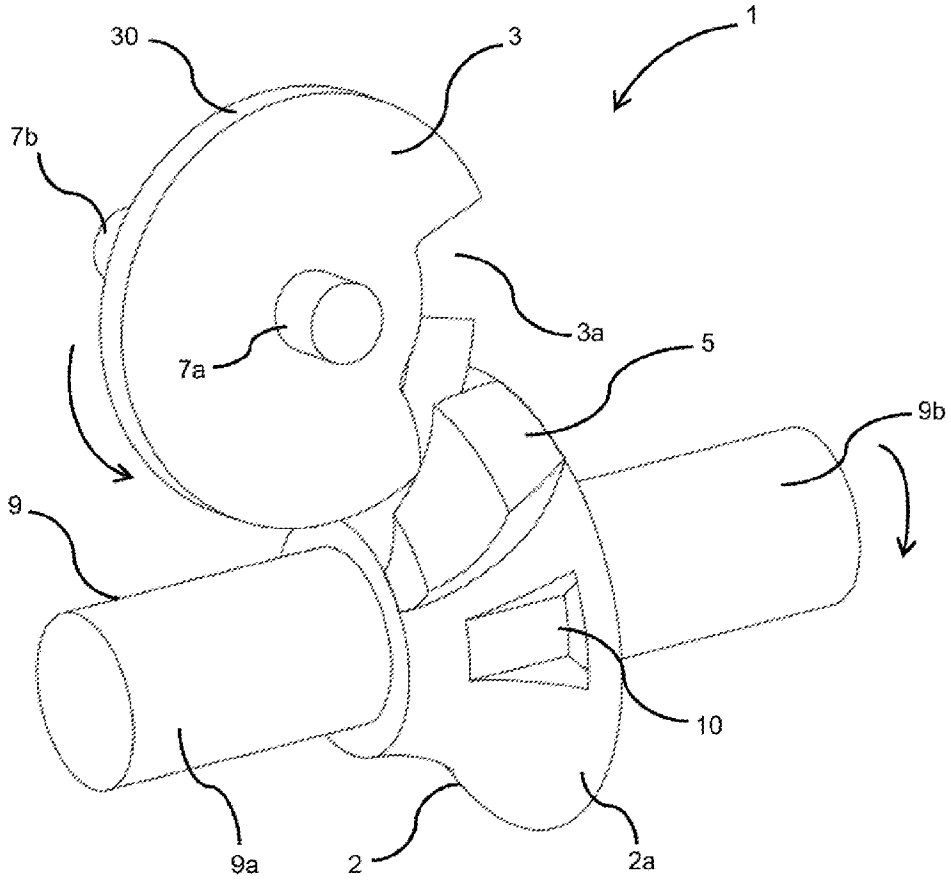
FIG. 1*b* is a perspective view of the rotary piston and cylinder device components in FIG. 1 from a different orientation.

With reference in particular to FIGS. 1A and 1B, there are shown different perspectives the rotor and shutter arrangement, excluding the stator or housing. As can be seen in both views, there is provided a shaft 9, which comprises end portions 9*a* and 9*b*, which extends through the rotor 2.

To achieve this arrangement, the rotor 2 is provided with a central through-hole (not referenced). Advantageously, during assembly, the rotor can be assembled onto the shaft 9 by any suitable method. This can be achieved for rotors such as rotor 2 due to the large axial extent of the rotor, which allows for accurate alignment and secure attachment using means such as brazing or an interference fit.

The rotor 2, with the shaft in position in an assembly process, is then arranged so that relative movement to the shaft is prevented in operation. The rotor 2 is located intermediate of the end portions 9*a* and 9*b*. Depending on how the device 1 is used, in terms of its operational application, the shaft may be used to provide rotational input or output.

As is evident, since the piston 5 is of relatively wide dimension, the opening 3*a* of the shutter 3 must be accordingly proportioned, in order to allow the piston to pass through the opening. It will be appreciated, and is to some extent evident in the drawings, that the boundary of the opening 3*a* has to be suitably configured/profiled to take account of the relative movement between the piston and the shutter disc.

The rotor 2 is provided with an (internal) port 10 which extends from the surface 2*a* through to the opposite, or what could be termed 'rearward' surface of the rotor, since this extends away from the rotor surface 2*a* in a generally axial direction.

As will be described further below, this conveniently allows for fluid to be transferred to or from the annular or working chamber of the device. This may be for example compressed fluid.

Figure 2A:
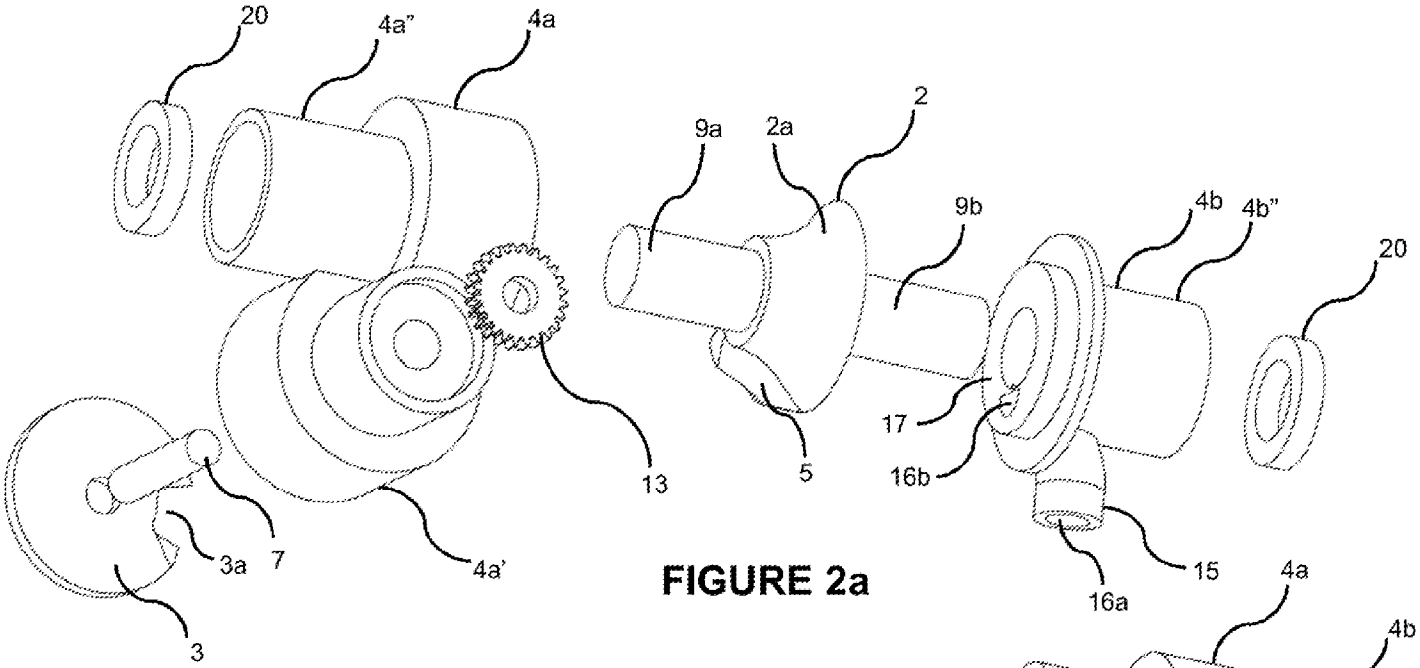
FIG. 2*a* is an exploded view of the rotary piston and cylinder device of the preceding Figures.
Figure 2B:
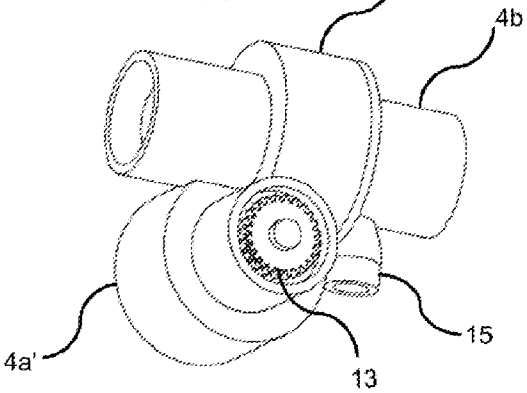
FIG. 2*b* is a perspective view of the assembled device from FIG. 2*a*
Figure 3B:
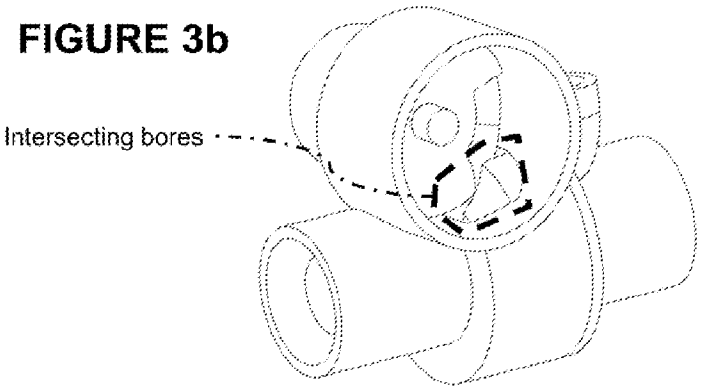
FIG. 3*b* is a perspective view of the assembled device from FIG. 3*a*
Figure 3A:
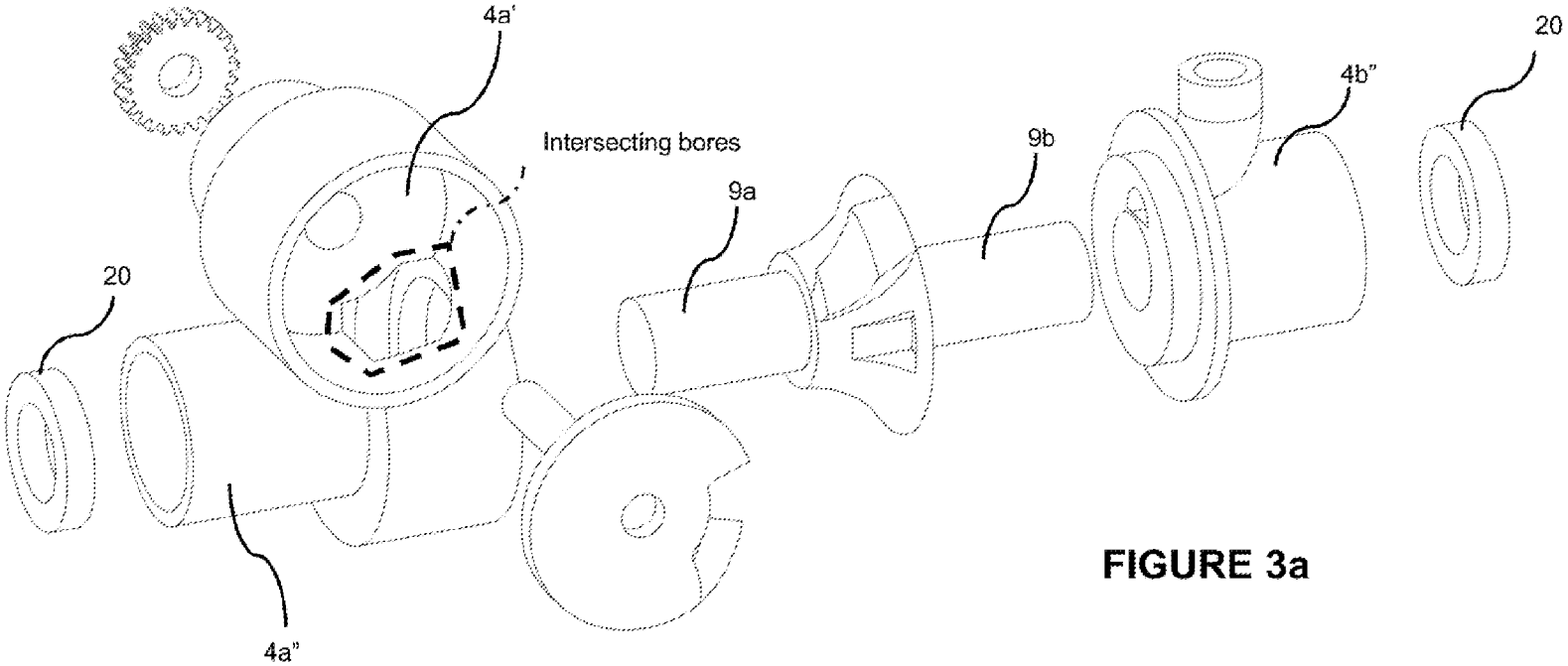
FIG. 3*a* is an exploded view of the rotary piston and cylinder device of FIG. 2*a* from a different orientation.
Figure 4:
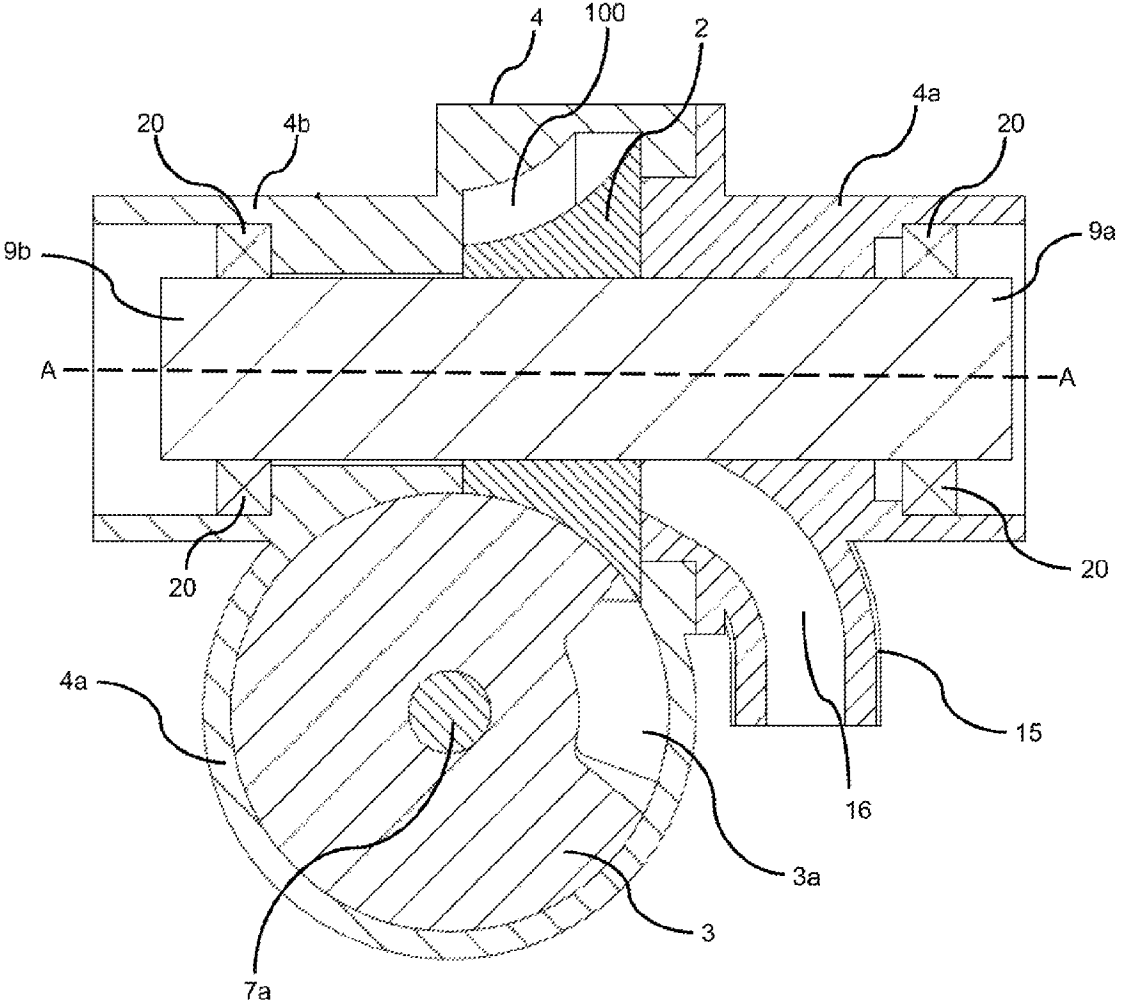
FIG. 4 is an axial cross-sectional view of the rotary piston and cylinder device of FIGS. 2 and 3, FIGS. 5*a*, 5*b* and 5*c* are axial cross-sectional views of a rotor of the device of FIG. 4, FIGS. 6, 7A, 7B, 8A and 8B show various alternative embodiments.

Reference is now made to FIGS. 2, 3 and 4, in relation to the structure and configuration of the stator 4. As can be seen in FIG. 2, the stator 4 comprises two parts, 4*a* and 4*b*.

As can be seen from FIGS. 2*a* and 3*a*, these two parts are brought together during assembly so as to house both the rotor and shutter disc. The stator part 4*a* can be seen as that part which accommodates both the rotor and the shutter disc. The part 4*a* is formed of two in part cylindrical portions which are arranged substantially orthogonal to each other.

In this embodiment the two portions are integral, with the portion which receives the shutter disc 3 shown as 4*a*'. This part also includes a portion 4*a*" which is arranged to receive a respective end portion 9*a* of the shaft 9, as well as a respective rotational bearing 20.

The part 4*b* includes a substantially cylindrical portion 4*b*" which is arranged to receive a bearing 20 and the shaft end portion 9*b*.

Depending from the part 4*b*, there is provided a formation 15, which in this example may be described as a spigot. This feature provides a port, such as an outlet port, for working fluid from the device. The formation 15 comprises a passageway 16, which forms a conduit between openings 16*a* and 16*b*. The opening 16*b* is provided on a face 17 of the part 4, and the above described port 10 of the rotor 2 is arranged to periodically come into register with the opening 16*b*.

The surface 17 is arranged to face, and be in close cooperation with, the rearward surface (unreferenced) of the rotor 2.

This means that as the rotor 2 rotates and the port 10 comes into alignment with the opening 16*b*, a passage is opened through which fluid can flow into and/or out of the annular chamber 100.

During assembly or manufacture of the device 1, the parts 4*a* and 4*b* can be rigidly attached together by way of fasteners or by some other way.

FIGS. 3*a* and 3*b* show the arrangement of the intersecting bores which are in the stator 4*a*, which conveniently, accommodates both passage of the piston as well as receipt of the shutter, and in combination form another port for fluid communicating fluid to the working chamber. In a compressor embodiment, this port can be an inlet port.

The shutter and rotor are kept in synchrony by the transmission. The toothed gear 13 of FIGS. 2 and 3 shows part of such a transmission.

Referring to FIG. 4, it can be seen that in the assembled condition, the rotor 2 and the stator 4 define the annular chamber 100. The shaft 9 being rotatably mounted by bearings 20 is arranged to rotate about an axis A-A. As alluded to previously, in addition to the porting provided by the passageway 16, typically providing an outlet port in a compressor embodiment of the device, formed in the stator 4, there is also provided a port (intersecting bores of FIG. 3) which in a similar embodiment provides an inlet for working fluid. In use, a transmission between the rotor and the shutter ensure the required synchronisation. If the device 1 is used as a compressor, a suitable motive or drive source can be attached to an end portion 9*a* or 9*b* of the shaft 9 or to the shaft 7 of the shutter means or to another part of the transmission.

Figure 5A:
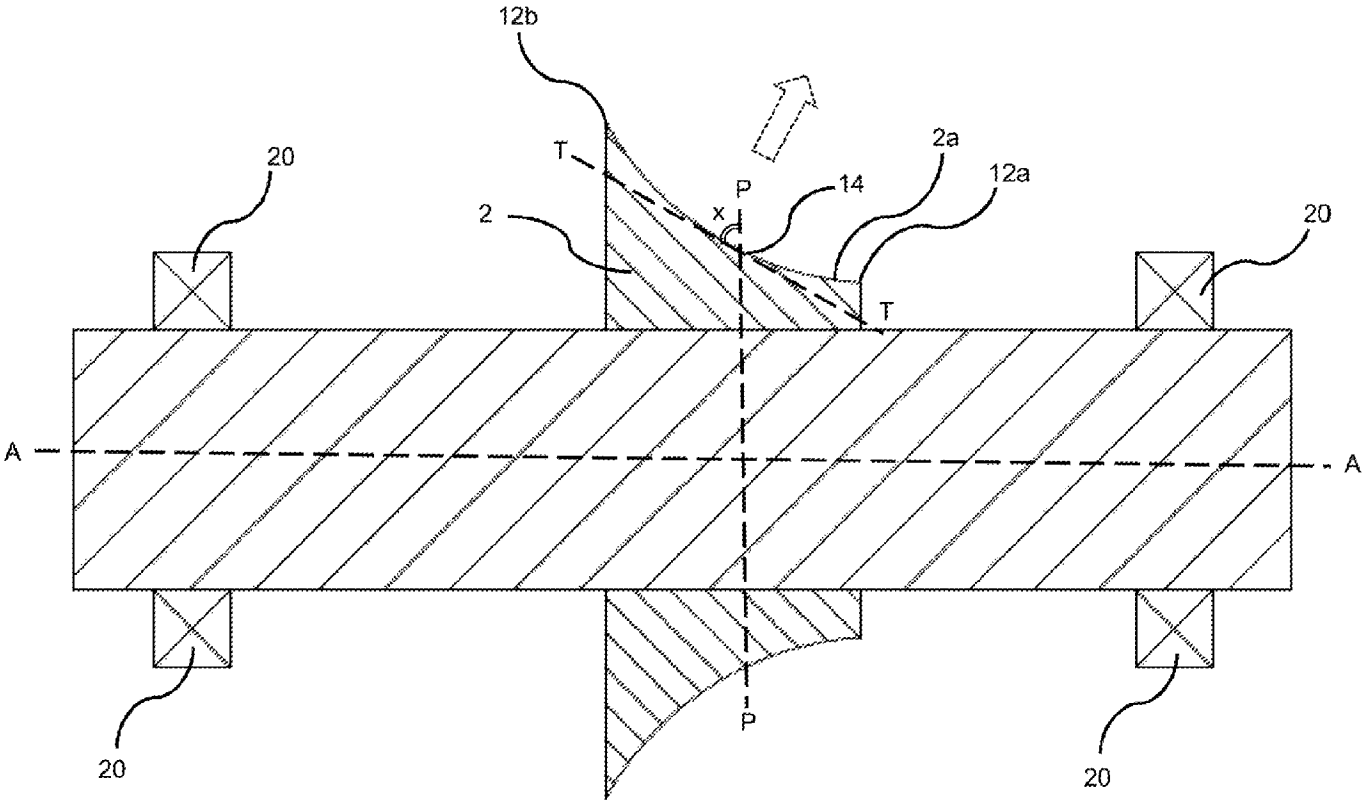

FIG. 5 serves to illustrate the geometric characteristic of the rotor 2 of the device 1. The rotor 2 may be described as being asymmetric. This asymmetry is with respect to a plane P-P, which extends through and bisects the rotor 2, at its mid-point 14. Its mid-point may be described as that which is midway between the distal end portions 12*a* and 12*b*, which define and bound the axial extent of the surface 2*a*.

The plane P-P is also orthogonal to the axis of rotation A-A. It can be seen that the concave (in cross-section) surface 2*a* is asymmetrical about the plane P-P. The rotor surface itself, as indicated by the arrow, faces generally away and outwardly of the axis of rotation A-A. A measure of the angle of orientation can be determined by taking a tangent T at the point of intersection between the plane P-P, and the rotor surface 2*a*. It is thereby possible to determine an angle of orientation x between the tangent line T-T and the plane P-P.

Figure 5B:
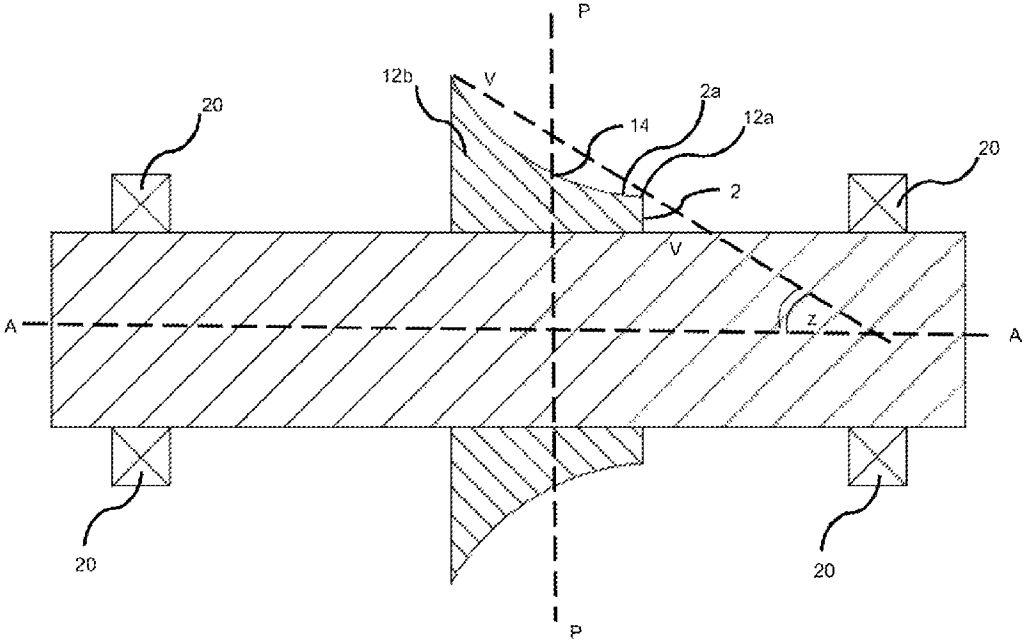

As an alternative way to describe the inclined, outward, orientation of the rotor surface 2*a*, reference is made to FIG. 5*b*. A straight line V is generated between the distal end regions 12*a* and 12*b* of the rotor surface 2*a*, and angle of inclination of the rotor surface could be determined by considering the angle between the connecting line V, and the axis of rotation A-A by extrapolating the line V, as shown in the Figure, and determining the subtended angle of incline z.

Figure 5C:
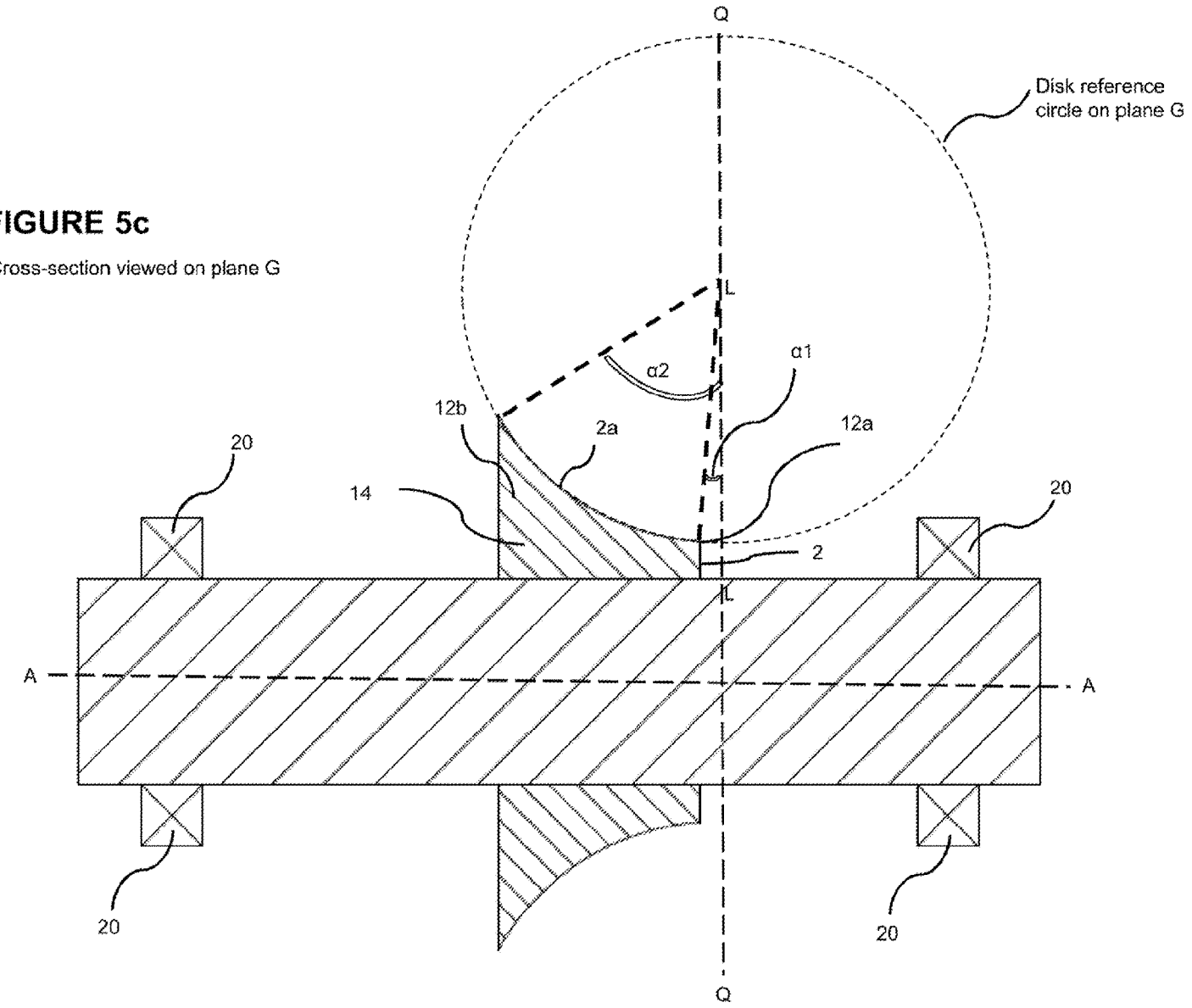

Yet a further way to consider the orientation of the rotor surface 2*a* is shown in FIG. 5*c*. In FIG. 5*c* a cross section plane G (on which the cross-section of the Figure is shown) is a generating plane, which is the plane on which the circular circumference of disk defines the surface 2*a*. A reference line L is then drawn on G, along its intersection with a plane normal to the rotor axis (which is coincident with the disk axis intersection point on the generating plane). A plane Q is a plane normal to G, coincident with the disk axis and the reference line L. In the preferred case of a perpendicularly positioned disk, Q is parallel to P (see FIG. 5*b*). The extent of the chamber is then defined on plane G by two angles (alpha1 and alpha2) about the shutter axis from L. An asymmetric working chamber may be defined as one where alpha1 and alpha2 are not equal. Alpha1 and alpha2 may be of opposite sense around L. As an example, the two angles may be 15 deg and 65 deg, respectively. However, more generally, the angles may be in the ranges alpha1: 0-30 degrees and, alpha2: 50-90 degrees, respectively. These ranges correspond to an angular range of 60 degrees to 25 degrees for angle z described above.

There are numerous and significant advantages of the device described above.

Having a port or ports through the rotor communicating with a further port or ports in the stator allows fluid flow to or from the annular chamber to be controlled or effectively valved.

The device 1 allows for easier assembly of rotor and shutter disk. Since the rotor does not symmetrically wrap around the disk, the order of assembly can be achieved in more different ways such that the stator can be designed for lower cost and/or more accurate manufacture. For example, in some known piston and cylinder devices, the shutter disk has to be inserted radially with respect to the rotor. In device 1, the rotor can also conveniently be assembled along axis A-A onto the shutter disc.

The device 1 allows for inclusion of a stiffer piston 5. Because the chamber 100 receives around 90° of the shutter (rather than around 45° in the prior art), the piston is better supported, so it is stiffer for a given thickness Since there is no need for the shutter disk to fit within the radial constraints of the annular chamber, the shutter and rotor can be sized independently (while achieving a desired working chamber volume), which gives design flexibility for relative component sizes and bearing loads, as compared to some known types of rotary piston and cylinder devices.

A smaller rotor diameter for given chamber dimensions can be achieved. The rotor does not have to extend radially beyond the chamber, which means that for a given chamber cross-section and volume the maximum rotor diameter is smaller. This reduces cost, distortion during running, and reduces total machine size.

Furthermore, due to the design flexibility as described above, the chamber can be designed to have a larger cross-section and hence a smaller outer diameter for a given chamber volume. This in combination with the immediately preceding point above means that the rotor can have a significantly lower outer diameter than possible with known rotor designs.

In relating to existing devices, reduced bearing loads can also be achieved. The chamber has a lower surface area to volume ratio.

This means that the forces exerted by the working fluid (due to its pressure being different to external or atmospheric pressure) will generally be lower. Specifically, the axial and radial forces exerted on the rotor may be reduced.

Since the rotor structure is now (generally) internal of the chamber, with no need for any other recesses once assembled, it can be made much stiffer. This can be seen as a reduction in the length of thin-walled sections on the rotor. A stiffer rotor means less deformation during running, which can reduce the clearances around the working chamber during operation and can reduce the amount of leakage of working fluid.

Reduced bearing loads. In addition to the reduced forces exerted by the working fluid, the rotor design allows a bearing to be simply placed on either side of the chamber, whilst known rotor designs require the chamber to overhang the bearings. This greatly reduces the bearing loads, increasing service life and/or reducing the size/cost of bearings.

Reduced leakage. Due to the reduced surface area/volume, as outlined above, the leakage paths have a smaller extent for a given chamber volume.

Reduced maximum casting dimensions, from simpler and smaller parts, assuming the main rotor and housing parts are cast, which can reduce the cost of casting by enabling the use of smaller machines. The machining cutting speed can also be faster (or tolerance can be finer), as it can be simpler to support the rotor closer to the machined faces.

The rotor can be press-fitted to the shaft or otherwise assembled to the shaft as mentioned above, which reduces manufacturing complexity as the two constituent parts can be simpler to manufacture than if made as a single component. This assembly also allows the rotor and shaft to employ different materials in their construction.

Reference is made to the remaining Figures which show some examples of variant embodiments, but all still embodying the same principle as that described above. Firstly, reference is made to FIG. 6, which shows a variant transmission toothed gear 106 is spaced from the shutter disc 3, and thereby allowing a larger chamber (as can be seen from the modified opening 103' and piston 5').

Figure 7A:
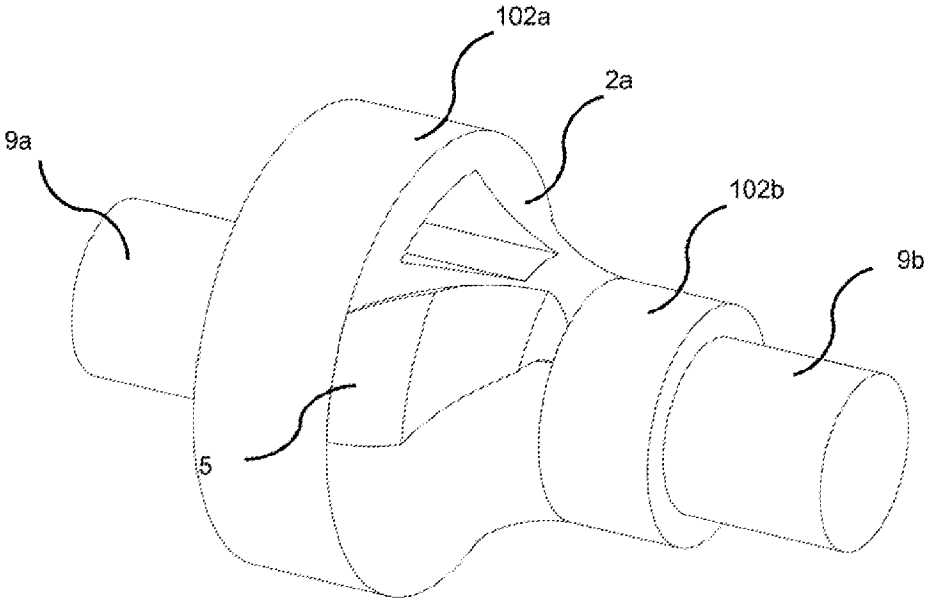
Figure 7B:
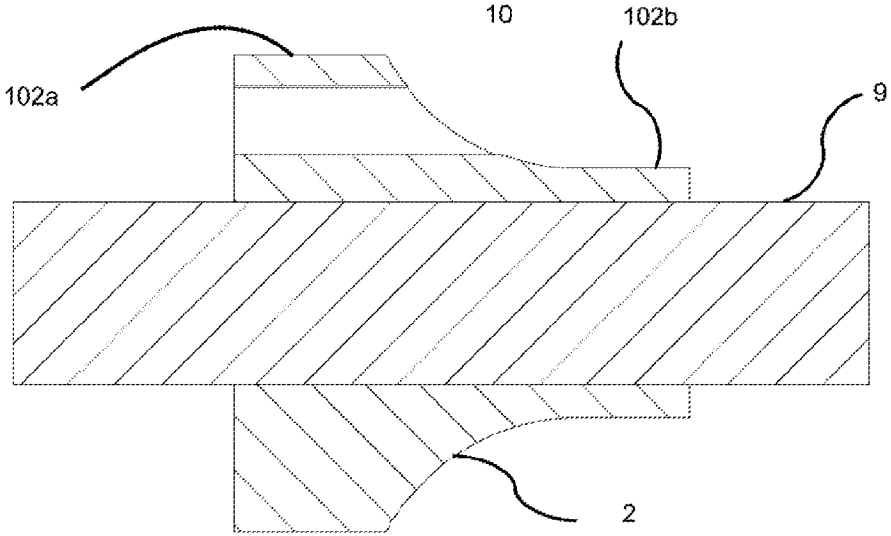

FIGS. 7A and 7B show an alternative embodiment in which the rotor includes axial extensions 102*a* and 102*b* which can be used for enhanced sealing by provisioning a greater sealing area. Although the surface 102*b* may be geometrically continuous with surface 2*a*; 102*b* is not functionally a continuation of 2*a* as it does not define an aspect of the working chamber.

Figure 8A:
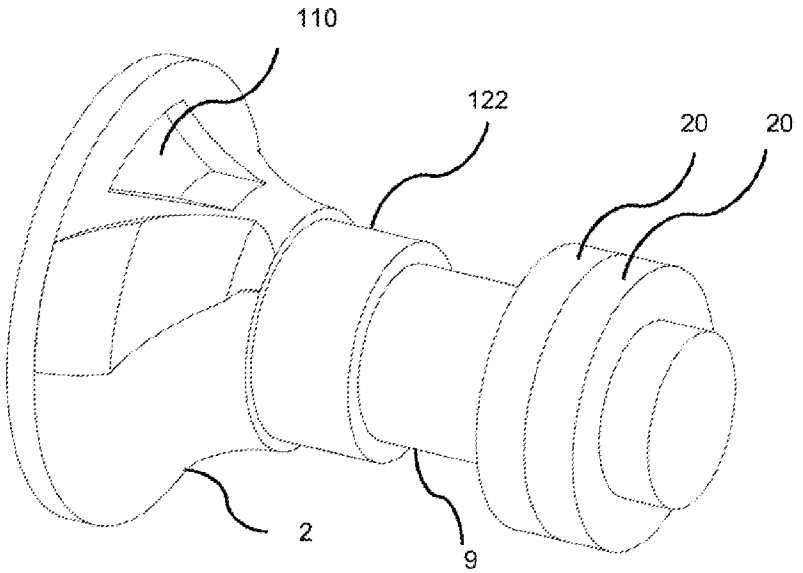
Figure 8B:
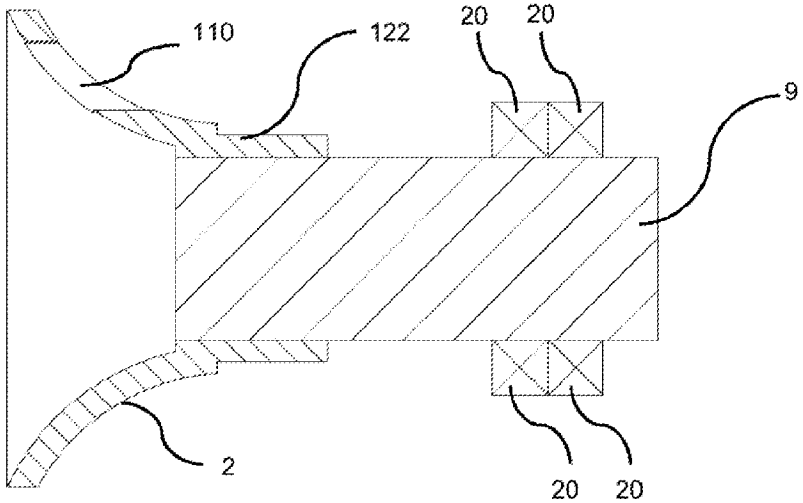

FIGS. 8*a* and 8*b* show an embodiment where shaft 9 extends substantially only in one direction from the rotor. This means that it is required to be supported by bearings spaced only on that same side of the rotor. While this increases bearing loads for a given chamber, it may be advantageous in other ways, such as more compact bearing oil systems, or to distance the bearings from the generally increased temperatures around the working chamber.

Figure 9:
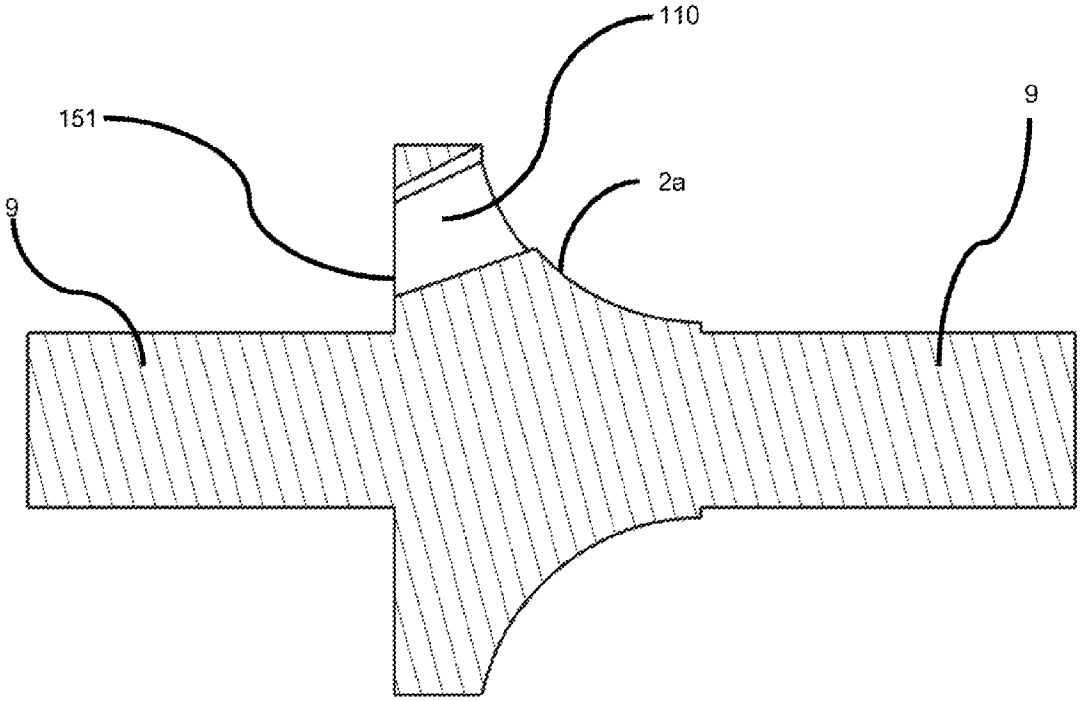
FIGS. 9, 10, 11 and 12 are cross-sections of various embodiments of a rotor.
Figure 10:
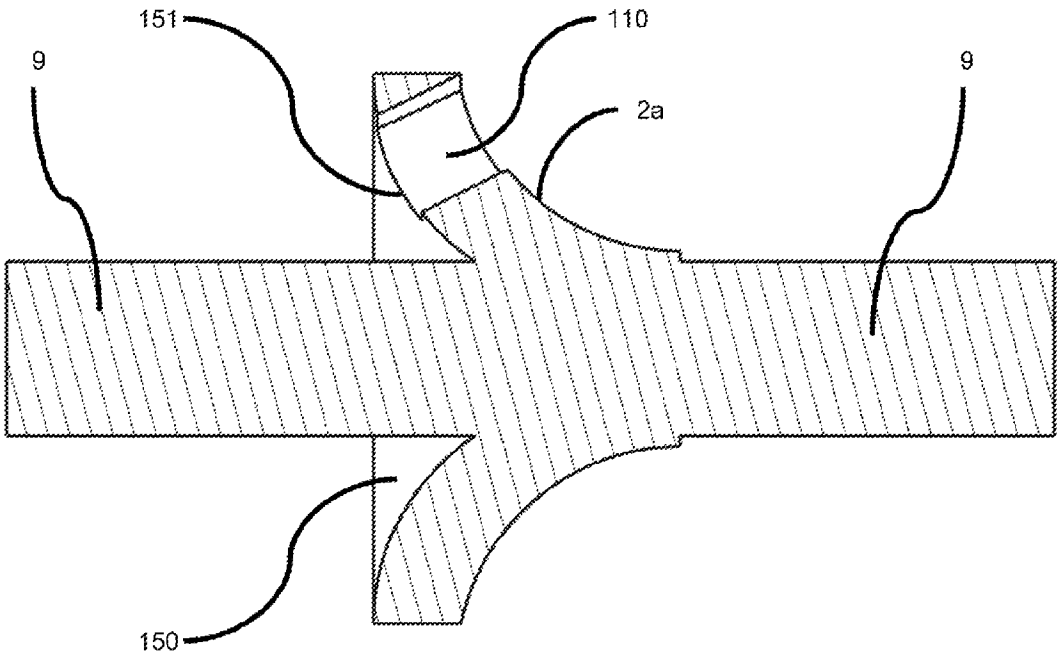
Figure 11:
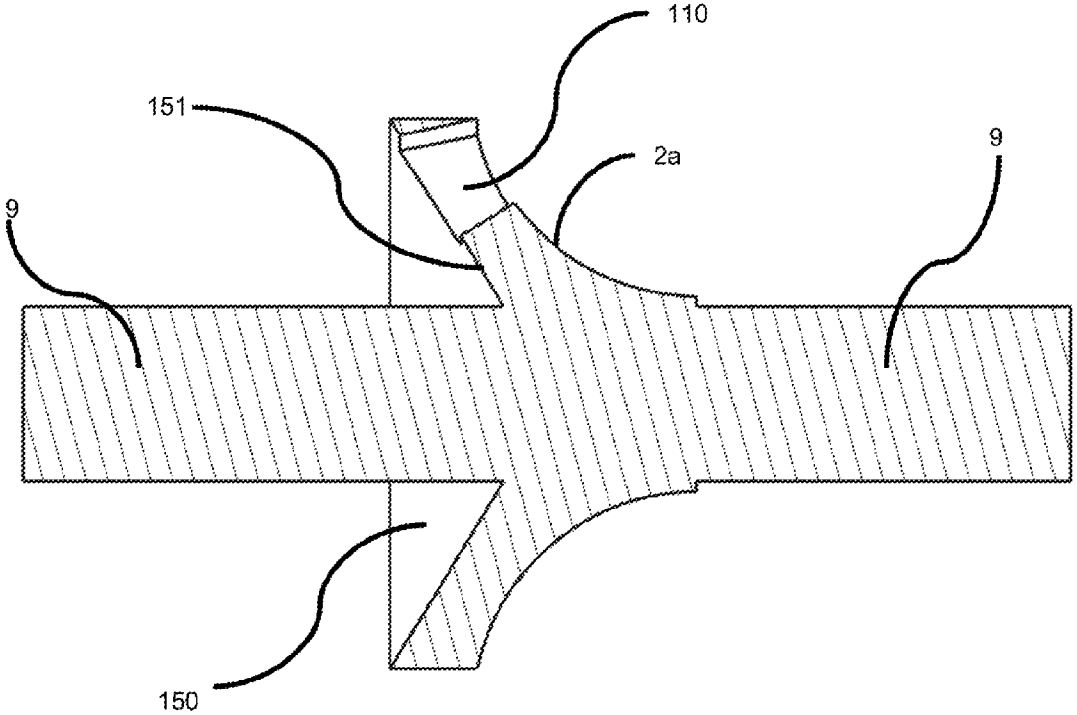
Figure 12:
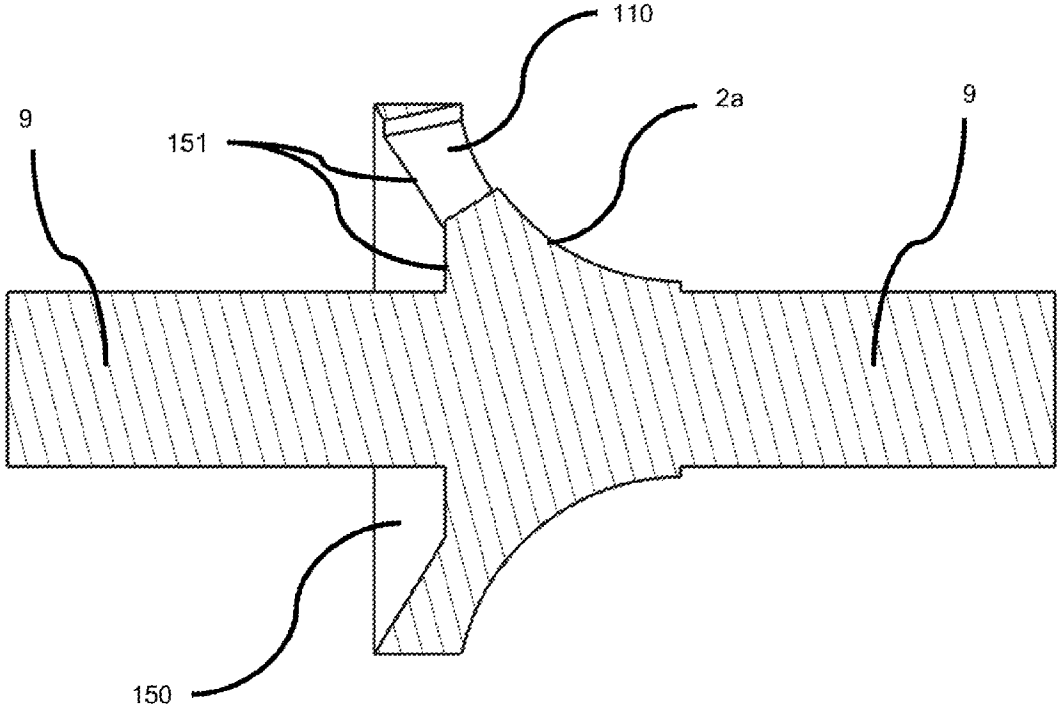

FIGS. 9, 10, 11 and 12 show variant embodiments of a rotor in which the rearward regions 150 of the rotor can be defined by undercuts, or spaces in that region, thus demonstrating that the rotor surface body need not necessarily be solid. The regions 150 may in part be defined by a rearward wall or face denoted generally by reference numeral 151. In FIG. 9 the rearward face 151 is substantially planar which is simple to machine and results in high stiffness, but increases the volume of port 110, which can lead to decreased performance. In FIG. 10, the rearward face 151 is of a similar curvature to the surface 2*a*, such that the rotor has a generally constant thickness. This can reduce the volume of port 10, but is more complicated to machine. In FIG. 11, the rearward face 151 is substantially frusto-conical, which is cheaper to machine (or can allow it to be repeatedly machined to a higher accuracy), while also minimising the volume of port 10. Finally in FIG. 12 the rearward face 151 is composed of both a frusto-conical and a planar portion. This serves to reduce the volume of port 10, reduce the cost of manufacture, and also to increase the stiffness of rotor 2, to better resist distortion.

The invention claimed is:

1. A rotary piston and cylinder device comprising:

a rotor, having a rotor surface, a stator, a rotatable shutter disc, the rotatable shutter disc provided with a slot, a piston which extends from the rotor surface, said slot of the rotatable shutter disc arranged to allow the piston to pass therethrough during operation of the device, the rotor surface and the stator together defining an annular chamber, and the piston arranged to rotate through the annular chamber, and the rotor surface faces away from, or outwardly of, an axis of rotation of the rotor, and the rotor surface is of a curved flared profile when viewed in axial cross-section, and said curved flared profile extends between a first rotor surface end region and a second rotor surface end region, and the first rotor surface end region being spaced along the axis of rotation of the rotor with respect to the second rotor surface end region, and one of the rotor surface end regions having a greater radial extent than the other rotor surface end region, and the rotary piston and cylinder device further comprising a transmission assembly having a toothed gear, the transmission assembly configured to maintain timing of the rotatable shutter disc in synchrony with the rotor.

2. A rotary piston and cylinder device as claimed in claim 1 further comprising a rotational shaft which extends from at least one of the first rotor surface end region and the second rotor surface end region.

3. A rotary piston and cylinder device as claimed in claim 2 in which the at least one axial end of the rotor comprises two axial ends of the rotor, and a second end of the rotational shaft extends from the other of the two axial ends of the rotor.

4. A rotary piston and cylinder device as claimed in claim 2 in which the rotor comprises a through opening through which the shaft extends or is received.

5. A rotary piston and cylinder device as claimed in claim 1 in which the rotor surface is provided with a port to allow communication of fluid between the annular chamber and a space external of said annular chamber.

6. A rotary piston and cylinder device as claimed in claim 5 in which the rotor has an end surface in the second rotor surface end region and the port comprises an opening which extends inbound towards the shaft, and an edge of the opening at the rotor surface is axially spaced from the end surface of the rotor in a direction of the axis of rotation.

7. A rotary piston and cylinder device as claimed in claim 1, wherein the rotatable shutter disc is provided with exactly one slot.

* * * * *